US011333142B2

(12) United States Patent
Ishimaru et al.

(10) Patent No.: US 11,333,142 B2
(45) Date of Patent: May 17, 2022

(54) TUBE BODY AND PUMPING DEVICE

(71) Applicant: Tokyo Electron Limited, Tokyo (JP)

(72) Inventors: Daisuke Ishimaru, Koshi (JP); Katsuya Hashimoto, Koshi (JP); Yasuhiro Takaki, Koshi (JP)

(73) Assignee: Tokyo Electron Limited, Tokyo (JP)

( * ) Notice: Subject to any disclaimer, the term of this patent is extended or adjusted under 35 U.S.C. 154(b) by 43 days.

(21) Appl. No.: 16/775,468

(22) Filed: Jan. 29, 2020

(65) Prior Publication Data

US 2020/0256330 A1 Aug. 13, 2020

(30) Foreign Application Priority Data

Feb. 8, 2019 (JP) ..... JP2019-021420

(51) Int. Cl.
*F04B 43/08* (2006.01)
*F04B 43/00* (2006.01)
*F04B 43/10* (2006.01)

(52) U.S. Cl.
CPC ..... *F04B 43/0072* (2013.01); *F04B 43/08* (2013.01); *F04B 43/084* (2013.01); *F04B 43/10* (2013.01)

(58) Field of Classification Search
CPC .. F04B 43/084; F04B 43/107; F04B 43/0054; F04B 43/0072; F04B 43/08; F04B 43/10; F04B 45/06; F04B 45/061; F04B 45/073; F16L 11/121
USPC ..... 138/30, 118.1, 119, 128, 177, 178, 138/DIG. 11
See application file for complete search history.

(56) References Cited

U.S. PATENT DOCUMENTS

| | | | | |
|---|---|---|---|---|
| 6,789,579 | B1 * | 9/2004 | Ryhman | B29C 48/09 138/121 |
| 7,677,271 | B2 * | 3/2010 | Boettner | F16L 37/084 138/119 |
| 7,896,033 | B2 * | 3/2011 | Hallot | F16L 1/16 138/149 |
| 9,052,054 | B2 * | 6/2015 | Nobileau | E21B 19/22 |
| 2008/0072983 | A1 * | 3/2008 | Wu | F16L 9/003 138/118 |
| 2009/0320951 | A1 * | 12/2009 | Witz | F16L 11/10 138/125 |
| 2016/0116845 | A1 * | 4/2016 | Sasa | F04B 43/08 700/282 |

FOREIGN PATENT DOCUMENTS

JP H10-061558 A 3/1998

* cited by examiner

*Primary Examiner* — Bryan M Lettman
*Assistant Examiner* — Dnyanesh G Kasture
(74) *Attorney, Agent, or Firm* — Posz Law Group, PLC

(57) ABSTRACT

There is disclosed a hollow tube body used for a liquid feeding member and deformable by pressurization, wherein: an axial cross-section of the tube body has two opposing long side parts and two opposing short side parts; four corner portions formed by the long side parts and the short side parts each have a shape curved to protrude outward; each of the long side parts has a recessed part recessed inward and continuing from the corner portions; and a portion other than the corner portions of each of the short side parts is in a flat shape.

12 Claims, 6 Drawing Sheets

TUBE BODY AND PUMPING DEVICE

CROSS REFERENCE TO RELATED APPLICATIONS

This application is based upon and claims the benefit of priority of the prior Japanese Patent Application No. 2019-21420, filed in Japan on Feb. 8, 2019, the entire contents of which are incorporated herein by reference.

BACKGROUND OF THE INVENTION

1. Field of the Invention

This disclosure relates to a tube body and a pumping device.

2. Description of the Related Art

In Japanese Laid-open Patent Publication No. H10-61558 1 discloses a chemical supply apparatus including: a flexible tube formed of an elastic material and elastically expandable and contractible in a radial direction; a supply-side flow path connected between one end part of the flexible tube and a chemical storage part and provided with a supply-side open/close valve; a discharge-side flow path connected between the other end part of the flexible tube and a chemical discharge part and provided with a discharge-side open/close valve; a bellows arranged outside the flexible tube and elastically deformable in an axial direction which includes a small-sized bellows part and a large-sized bellows part both of which are formed of elastic members, the large-sized bellows part being larger in volume change per unit displacement amount in the axial direction than the small-sized bellows part; an incompressible medium sealed between the flexible tube and the bellows; and drive means which elastically deforms the flexible tube in the radial direction by elastically deforming the bellows in the axial direction to contract the small-sized bellows and expand the large-sized bellows whereas expanding the small-sized bellows and contracting the large-sized bellows.

SUMMARY OF THE INVENTION

An aspect of this disclosure is a tube body for liquid feeding member, which is a hollow tube body used for a liquid feeding member and deformable by pressurization, wherein: an axial cross-section of the tube body has two opposing long side parts and two opposing short side parts; four corner portions formed by the long side parts and the short side parts each have a shape curved to protrude outward; each of the long side parts has a recessed part recessed inward and continuing from the corner portions; and a portion other than the corner portions of each of the short side parts is in a flat shape.

According to this disclosure, the life of the tube body can be improved.

DETAILED DESCRIPTION OF THE INVENTION

Figure 1:
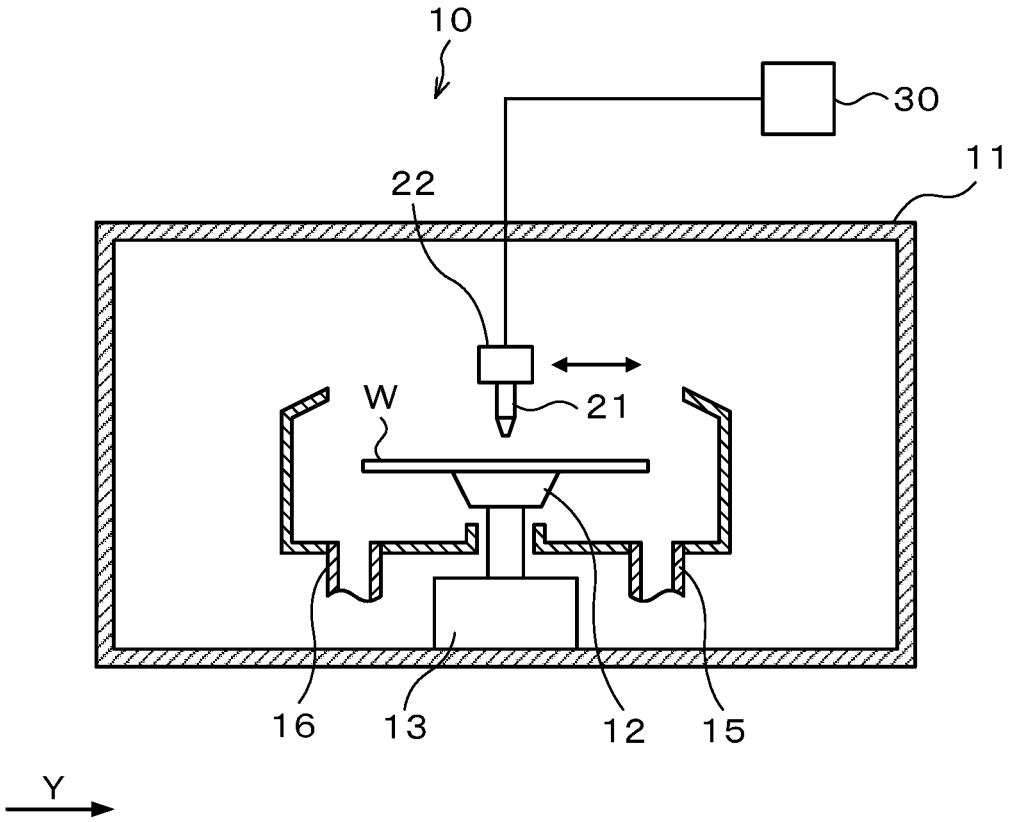
FIG. 1 is a longitudinal sectional view schematically illustrating the outline of a configuration of a resist coating apparatus employing a tube body according to an embodiment and installed in a treatment solution supply system.

In a photolithography process in a manufacturing process of a semiconductor device, treatment solutions such as a resist solution, a developing solution and the like are used for forming a coating film such as an anti-reflection film and a resist film on a treatment object such as a semiconductor wafer (hereinafter, referred to as a "wafer") and for developing an exposed resist film.

Each of the treatment solutions is fed in a fixed quantity required for the treatment every time, for example, to a supply nozzle. In the feeding, conventionally, a so-called tubephragm pump, which is configured to guide a treatment solution chemical to the inside of a flexible tube body, is often used.

However, when the tube body is pressurized with, for example, air being pressurizing fluid during the feeding, the tube body is crushed by the pressure at the pressurization, and stress sometimes concentrates at a specific region of the tube body depending on the crushed situation at that time. Since this kind of tubephragm pump is repeatedly used, the aforementioned region at which the stress concentrates is likely to break. Therefore, the improvement in life is a problem.

Hence the technique according to this disclosure suppresses the above-explained concentration of the stress to thereby improve the life of the tube body.

Hereinafter, a tube body according to this embodiment is explained referring to the drawings. Note that in this specification, the same codes are given to components having substantially the same functional configurations to omit duplicated explanation.

<Resist Coating Apparatus>

FIG. 1 is a longitudinal sectional view illustrating the outline of a configuration of a resist coating apparatus 10 employing a tube body according to this embodiment and installed in a treatment solution supply system.

The resist coating apparatus 10 includes a treatment container 11 whose inside is closable. The treatment container 11 has a side surface formed with a transfer-in/out port (not illustrated) for the wafer W. At a center in the treatment container 11, a spin chuck 12 which holds and rotates the wafer W is provided. The spin chuck 12 has a horizontal upper surface, and the upper surface is provided with, for example, a suction port (not illustrated) for sucking the wafer W. By suction through the suction port, the wafer W can be suction-held on the spin chuck 12.

The spin chuck 12 includes a chuck drive mechanism 13 equipped with, for example, a motor and so on, and can rotate at a predetermined speed by the chuck drive mechanism 13. Further, the chuck drive mechanism 13 is provided with a raising and lowering drive source such as a cylinder so that the spin chuck 12 can move up and down.

Around the spin chuck 12, a cup 14 is provided which receives and collects liquid splashing or dropping from the wafer W. A drain pipe 15 which drains the collected liquid and an exhaust pipe 16 which exhausts the atmosphere in the cup 14 are connected to a lower surface of the cup 14.

A coating nozzle 21 which discharges the resist solution onto the wafer W on the spin chuck 12 is supported by an arm 22 movable in a predetermined direction in the treatment container 11. The coating nozzle 21 is connected to a resist solution supply apparatus 30 which supplies the resist solution as illustrated also in FIG. 2.

<Resist Solution Supply Apparatus>

Figure 2:
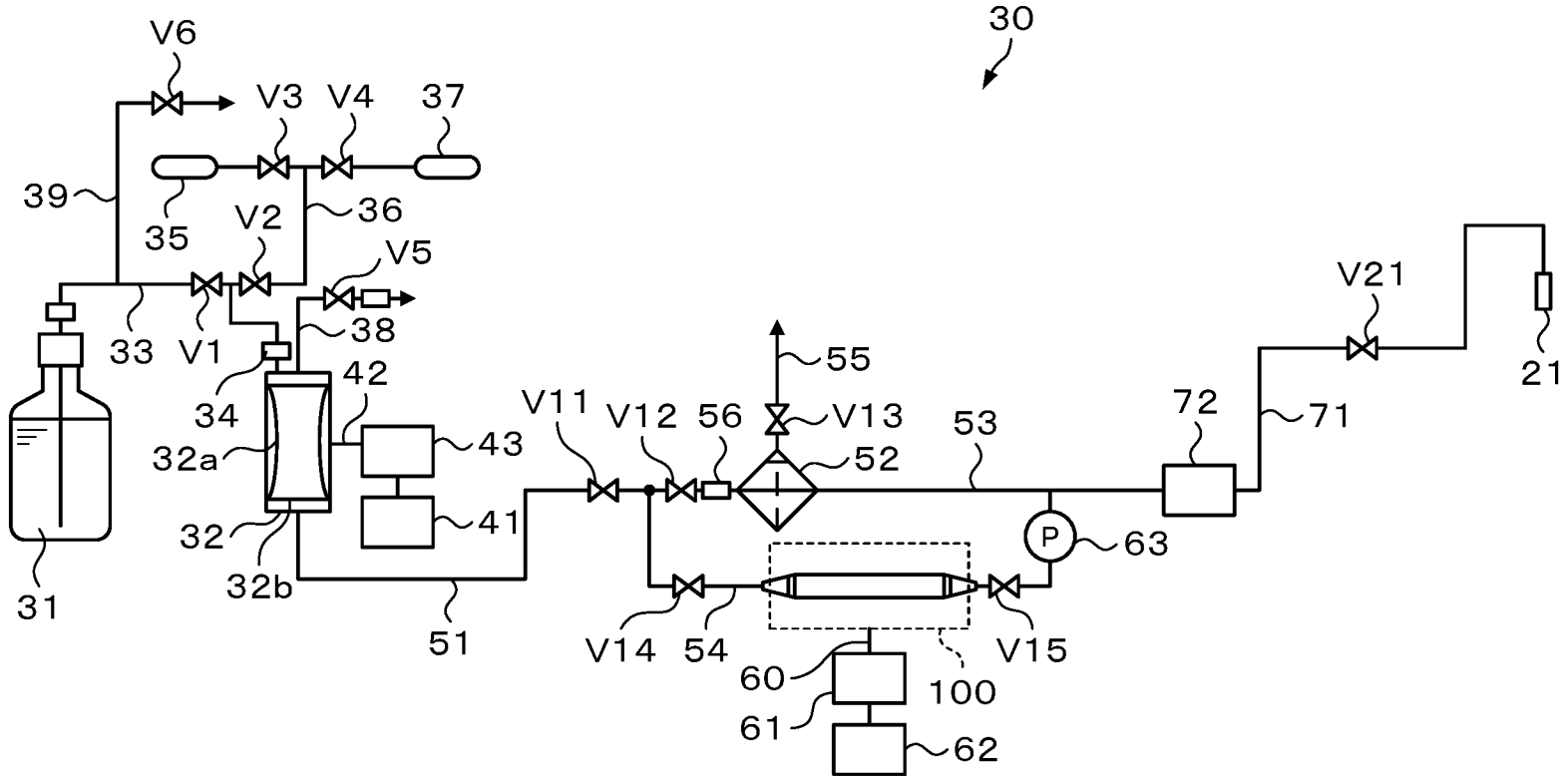
FIG. 2 is an explanatory view illustrating the outline of a system of a resist solution supply apparatus applied to the resist coating apparatus in FIG. 1.

Next, the configuration of the resist solution supply apparatus 30 which supplies the resist solution to the coating nozzle 21 as a treatment solution discharger is explained. FIG. 2 is an explanatory view illustrating the outline of a configuration of the resist solution supply apparatus 30. The resist solution supply apparatus 30 is provided, for example, in a chemical box (not illustrated). Note that the chemical box is intended for supplying various kinds of treatment solutions to solution treatment apparatuses.

The resist solution supply apparatus 30 includes a resist solution storage tank 31 being a resist solution supply source which stores the resist solution therein, and a buffer tank 32 which temporarily stores the resist solution transported from the resist solution storage tank 31.

The resist solution storage tank 31 is replaceable, and a first treatment solution supply pipe 33 which transports the resist solution to the buffer tank 32 is provided at the upper portion of the resist solution storage tank 31. The first treatment solution supply pipe 33 is provided with a valve V1 and a flowmeter 34.

On the downstream side of the valve 1 along the first treatment solution supply pipe 33, a flow path 36 is connected which leads to a pressurization source (for example, a nitrogen gas supply source) 35 for draining the resist solution in the buffer tank 32 by pressurizing the inside of the buffer tank 32. The flow path 36 is provided with valves V2, V3. The flow path 36 also leads to a cleaning solution supply source 37 via a valve V4 in a parallel way. By opening/closing operations of the valves V1 to V4, the supply of the resist solution from the resist solution storage tank 31 to the buffer tank 32, the drainage of the resist solution from the buffer tank 32, the supply of a cleaning solution to the buffer tank 32 and so on are performed.

The buffer tank 32 temporarily stores the resist solution transported from the resist solution storage tank 31 and has a pressure-feeding function of pressure-feeding the resist solution stored therein. The buffer tank 32 is composed of, for example, a tubephragm pump and includes a flexible diaphragm 32*a*, and the diaphragm 32*a* forms a storage chamber 32*b* which temporarily stores the resist solution. The capacity inside the storage chamber 32*b* is variable by deformation of the diaphragm 32*a*. Accordingly, the contact between the resist solution and gas inside the storage chamber 32*b* can be minimized also at the replacement of the resist solution storage tank 31.

At an upper portion of the buffer tank 32, a drain pipe 38 is provided which is used in draining the resist solution in the buffer tank 32.

The drain pipe 38 is provided with a valve V5 which functions as a drain valve. Note that also to the first treatment solution supply pipe 33, a drain pipe 39 having a valve V6 is connected.

To the buffer tank 32, an electropneumatic regulator 41 for deforming the diaphragm 32*a* is connected via an air supply/exhaust pipe 42. The air supply/exhaust pipe 42 is provided with a flowmeter 43. To the electropneumatic regulator 41, not-illustrated pressurization source and depressurization source are connected. An operation of switching between the pressurization source and the depressurization source can deform the diaphragm 32*a*.

At a lower portion of the buffer tank 32, a second treatment solution supply pipe 51 is provided. The second treatment solution supply pipe 51 branches off into a cleaning flow path 53 having a filter 52 and a flow path 54 leading to a later-explained pumping device 100. The filter 52 is intended for removing small bubbles in the resist solution. The removed bubbles are drained from a drain pipe 55 to the outside of the system. Note that the second treatment solution supply pipe 51 is provided with a valve V11, and the cleaning flow path 53 is provided with a valve V12 and a bubble detector 56.

The flow path 54 is provided with the pumping device 100 including the tube body according to the embodiment. The pumping device 100 has a tubephragm configuration. To the pumping device 100, an air supply/exhaust pipe 60 is connected. The air supply/exhaust pipe 60 is provided with a flowmeter 61 and an electropneumatic regulator 62. The electropneumatic regulator 62 controls pressurization and depressurization for the pumping device 100. Before and after the pumping device 100 along the flow path 54, valves V14, V15 and a pressure gauge 63 are provided.

The cleaning flow path 53 and the flow path 54 join again on the downstream side of the pressure gauge 63 and thereafter constitute a third treatment solution supply pipe 71, which leads to the coating nozzle 21. The third treatment solution supply pipe 71 is provided with a flowmeter 72 and a valve V21.

<Pumping Device>

Figure 3:
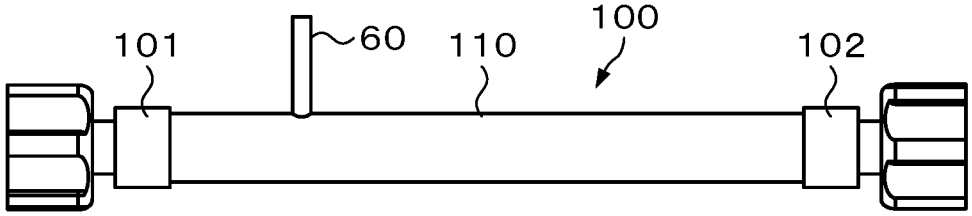
FIG. 3 is a side view of a pumping device used in the resist solution supply apparatus in FIG. 2.
Figure 4:
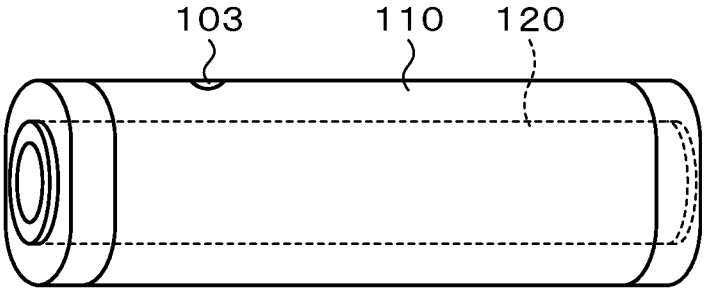
FIG. 4 is a perspective view of an outside tube body in the pumping device in FIG. 3.
Figure 5:
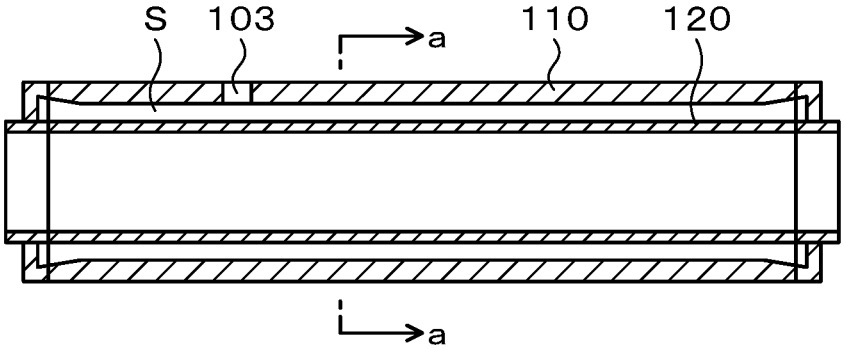
FIG. 5 is a side cross-sectional view of the outside tube body in FIG. 4.
Figure 6:
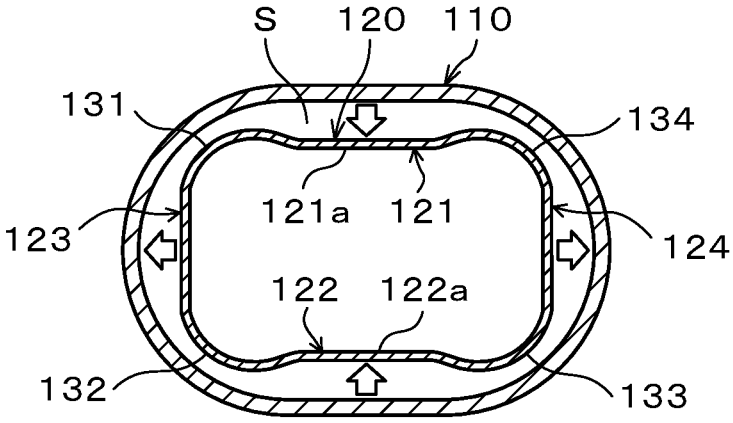
FIG. 6 is a cross-sectional view taken along a line a-a in FIG. 5.

The configuration of the pumping device 100 is explained in detail based on FIG. 3 to FIG. 6. FIG. 3 illustrates a side surface of the pumping device 100. The pumping device 100 includes, on its both end parts, connection parts 101, 102 to be connected to the flow path 54. The pumping device 100 includes an outside tube body 110 and a tube body 120 housed in the outside tube body 110 as illustrated in FIG. 4, FIG. 5, FIG. 6.

Each of the outside tube body 110 and the tube body 120 has a hollow shape and made of a flexible synthetic resin. The outside tube body 110 and the tube body 120 are fixed to each other at their both end parts by welding or the like, and a space S is formed between the outside tube body 110 and the tube body 120. The outside tube body 110 is formed with a hole 103 leading to the space S so that the aforementioned air supply/exhaust pipe 60 is connected to the hole 103.

FIG. 6 illustrates a cross-section taken along a line a-a in FIG. 5, namely, an axial cross-section. As illustrated in FIG. 6, the axial cross-section of the outside tube body 110 has an oval shape having arc parts on both sides. An axial cross-section of the tube body 120 housed inside the outside tube body 110 has opposing long side parts 121, 122 and opposing short side parts 123, 124. Four corner portions 131, 132, 133, 134 formed by the long side parts 121, 122 and the short side parts 123, 124 each have a shape curved to protrude outward.

The long side parts 121, 122 have recessed parts 121*a*, 122*a* recessed inward, respectively. In this embodiment, the recessed parts 121*a*, 122*a* of the long side parts 121, 122 each have a flat shape, and the portion having the flat shape becomes a flat part. Further, portions of the short side parts 123, 124 other than the corner portions 131, 132, 133, 134 are in a flat shape.

Figure 7:
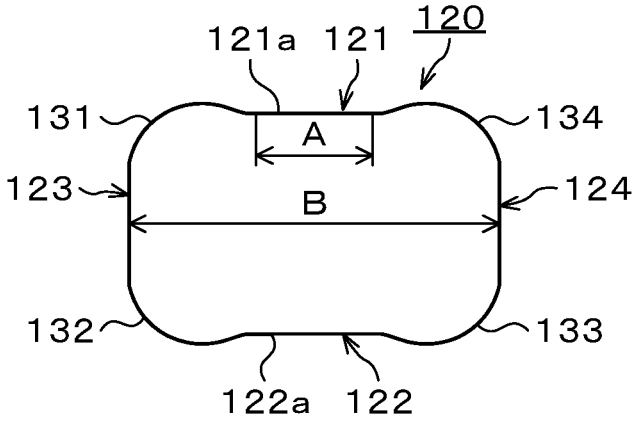
FIG. 7 is an explanatory view illustrating a size of a tube body according to the embodiment.
Figure 8:
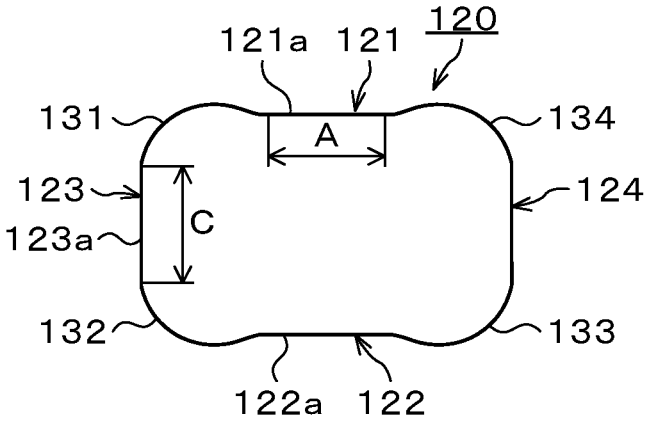
FIG. 8 is an explanatory view illustrating the size of the tube body according to the embodiment.
Figure 9:
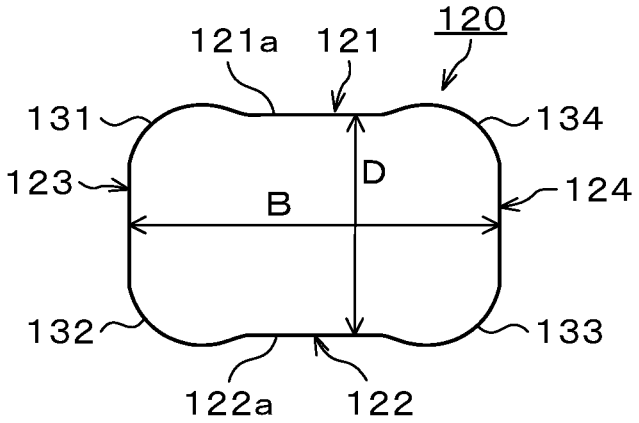
FIG. 9 is an explanatory view illustrating the size of the tube body according to the embodiment.

Next, the percentage of the size in the embodiment is explained based on FIG. 7 to FIG. 9. First, a straight line length of the recessed part 121*a*, 122*a* in the long side part 121, 122 is set to 20 to 60% of the length of the long side part 121, 122. Explaining the above in line with FIG. 7, A/B in the drawing is set to 20 to 60%, preferably 30 to 50%, and most preferably about 40%.

Further, the straight line length of the recessed part 121*a*, 122*a* of the long side part 121, 122 is set to 100 to 140% of the length of a portion 123*a* in a flat shape of the short side part 123, 124. Explaining the above in line with FIG. 8, A/C in the drawing is set to 100 to 140%, preferably 110 to 130%, and most preferably about 120%.

Further, the length of the long side part 121, 122, namely, the distance between the short side parts 123 and 124 is set to 150 to 190% of the distance between the recessed parts 121*a* and 122*a* of the long side parts 121, 122. Explaining the above in line with FIG. 9, B/D in the drawing is set to 150 to 190%, preferably 160 to 180%, and most preferably about 170%.

The above-explained percentages of the size have been found by the inventors through experiments and simulations. By selecting suitable percentages in the above ranges, for example, depending on the material and thickness of the tube body 120, the viscosity of the treatment solution fed by the tube body 120 or the like, a good result, namely, an improved life of the tube body 120 can be obtained.

<Action>

The pumping device 100 according to the embodiment has the above configuration, so that when a predetermined quantity of the treatment solution from the buffer tank 32, for example, the resist solution is supplied into the tube body 120 of the pumping device 100, the valve V14 is closed and the valve V15 and the valve V21 are opened. When fluid, for example, air at a predetermined pressure is supplied into the space S between the outside tube body 110 and the tube body 120 from the air supply/exhaust pipe 60 via the electropneumatic regulator 62 in the above state, the pressure is applied inward to the long side parts 121, 122 of the tube body 120 as illustrated in FIG. 6.

In this event, the long side parts 121, 122 are longer than the short side parts 123, 124 and have the recessed parts 121*a*, 122*a*, and therefore are likely to be crushed by the pressure. On the other hand, the short side parts 123, 124 of the tube body 120 are shorter than the long side parts 121, 122 and are in the flat shape at portions excluding the corner portions 131 to 134, and therefore unlikely to be deformed due to the pressurization.

Thus, the resist solution in the tube body 120 is appropriately pushed out of the inside of the tube body 120 and fed to the coating nozzle 21 through the third treatment solution supply pipe 71.

In this case, since the axial cross-section of the tube body 120 is a rectangle with rounded corners as a whole, namely, the four corner portions 131, 132, 133, 134 between the long side parts 121, 122 and the short side parts 123, 124 each have a shape curved to protrude outward and the long side parts 121, 122 are provided with the recessed parts 121*a*, 122*a* as explained above, the tube body 120 is likely to crush starting from the recessed parts 121*a*, 122*a*. On the other hand, the short side parts 123, 124 are shorter than the long side parts 121, 122 and are in the flat shape at portions excluding the corner portions 131 to 134, and therefore unlikely to be deformed due to pressurization. Since the corner portions 131, 132, 133, 134 each have a shape curved to protrude outward, a portion at which the stress concentrates is suppressed as a whole.

Accordingly, even in repeated use, deterioration and breakage of a specific region because of the concentration of the stress can be suppressed, and the life of the tube body 120 can be improved. Further, the employment of the above-explained shape makes it possible to easily predict the way of crush of the tube body 120 at pressurization. This also enables appropriate control of the way of crush (deformation) of the tube body at pressurization by appropriately changing the above-explained size percentages according to the material and thickness of the tube body 120, the viscosity of the treatment solution fed by the tube body 120 or the like.

Further, the short side parts 123, 124 are in the flat shape at portions excluding the corner portions 131 to 134 and are thus unlikely to be deformed during the feeding under pressure, so that the degree of the short side parts 123, 124 swelling outward during the feeding under pressure is small and can prevent their contact with the outside tube body 110. Also from this point, the life of the tube body 120 can be improved.

Other Embodiments

The technique according to this disclosure is not limited to the above shape. All of tube bodies in shapes illustrated in FIG. 10 to FIG. 11 can provide other effects and actions while suppressing the concentration of the stress.

Figure 10:
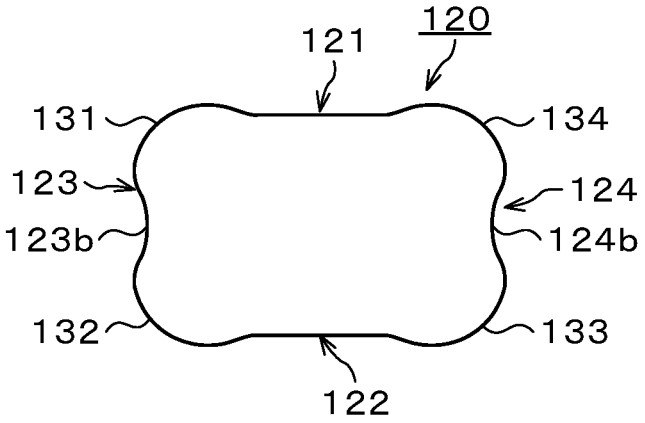
FIG. 10 is an explanatory view of a tube body according to another embodiment.

In a tube body 120 illustrated in FIG. 10, curved parts 123*b*, 124*b* protruding inward are provided at the short side parts 123, 124. This can further prevent the short side parts 123, 124 from swelling outward and coming into contact with the outside tube body 110 during the feeding under pressure. In addition, the volume of the space S between the tube body 120 and the outside tube body 110 can be increased to preferably feed a treatment solution with high viscosity.

Figure 11:
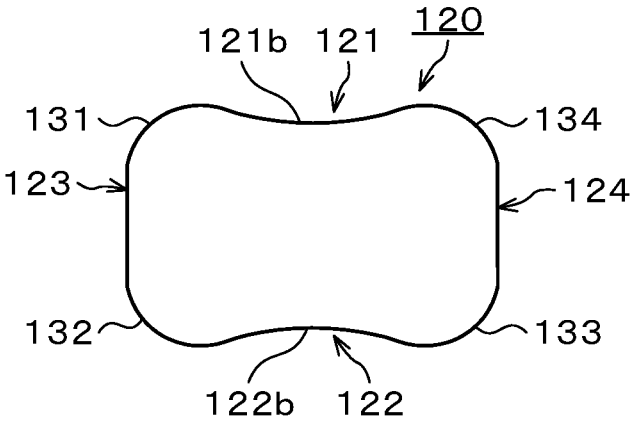
FIG. 11 is an explanatory view of a tube body according to another embodiment.

In a tube body 120 illustrated in FIG. 11, recessed parts 121*b*, 122*b* of the long side parts 121, 122 each have a shape curved to protrude inward. This can increase the volume of the space S between the tube body 120 and the outside tube body 110 to preferably feed a treatment solution with high viscosity.

Figure 12:
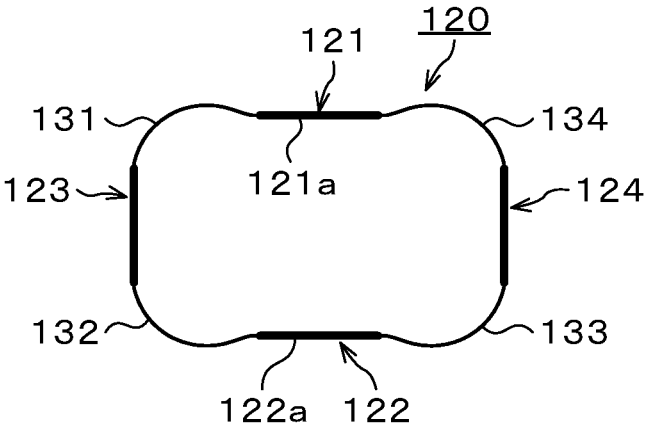
FIG. 12 is an explanatory view of a tube body according to another embodiment.

In a tube body 120 illustrated in FIG. 12, the recessed parts 121*a*, 122*a* of the long side parts 121, 122 and the flat portions of the short side parts 123, 124 are made of a material having a larger thickness than those of other portions of the tube body 120. Thus, the portions having the larger thickness are unlikely to be deformed due to pressurization. With this configuration, the portions having the larger thickness are less displaced during the feeding under pressure, with the result that the stress concentrates more at the corner portions 131 to 134, but the corner portions 131 to 134 each have the shape curved to protrude outward, so that the stress never concentrates at a specific region.

Figure 13:
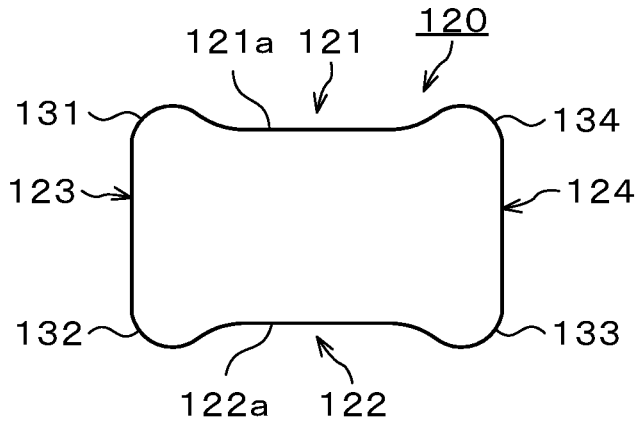
FIG. 13 is an explanatory view of a tube body according to another embodiment.

A tube body 120 illustrated in FIG. 13 is obtained by setting the flat portions of the recessed parts 121*a*, 122*a* of the long side parts 121, 122 and the flat portions of the short side parts 123, 124 longer than those of the tube bodies 120 illustrated in FIG. 7 to FIG. 9. According to the tube body 120 in FIG. 13 in this configuration, the stress tends to concentrate more at the corner portions 131 to 134, but the tube body 120 is a strong tube body as a whole.

Figure 14:
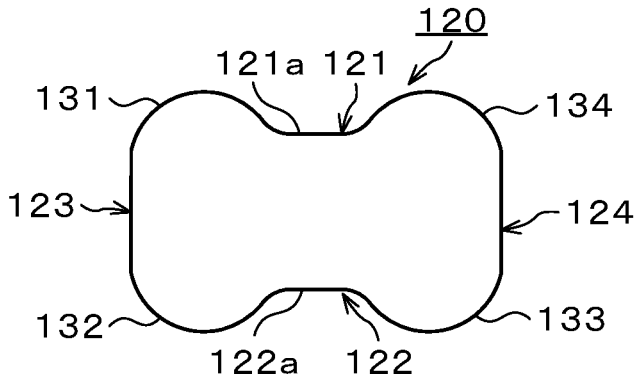
FIG. 14 is an explanatory view of a tube body according to another embodiment.

A tube body 120 illustrated in FIG. 14 is obtained by setting the recessed parts 121*a*, 122*a* of the long side parts 121, 122 shorter than those of the tube bodies 120 illustrated in FIG. 7 to FIG. 9. Along with the above, the corner portions 131 to 134 each have a shape swelling more toward the long side parts 121, 122. According to the tube body 120 in this shape, it becomes possible to increase the volume of the space S between the tube body 120 and the outside tube body 110 to preferably feed a treatment solution with high viscosity.

Figure 15:
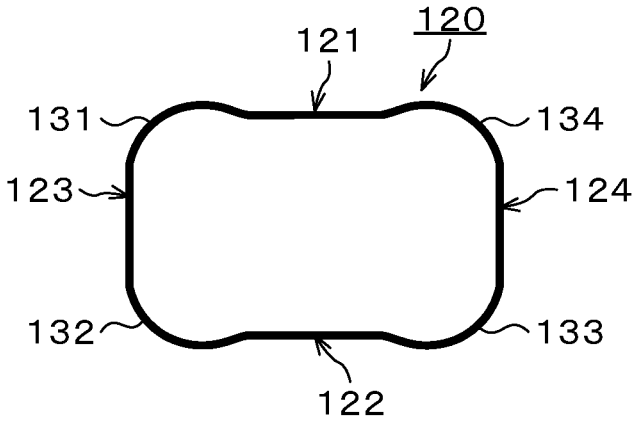
FIG. 15 is an explanatory view of a tube body according to another embodiment.

A tube body 120 illustrated in FIG. 15 is obtained by increasing the thickness of the synthetic resin constituting the tube body 120 than those of the tube bodies 120 illustrated in FIG. 7 to FIG. 9, thus making it possible, even if the stress concentrates at a specific region, to suppress the breakage of the specific region and further improve the life.

The embodiments disclosed herein are only examples in all respects and should not be considered to be restrictive. The above embodiments may be abbreviated, replaced, or changed in various forms without departing from the scope and spirit of the attached claims.

Further, it should be understood that those skilled in the art may arrive at various changes and modifications within the scope of the spirit as set forth in claims, and those should also belong to the technical scope of the claims of this application.

What is claimed is:

1. A hollow tube body used for a liquid feeding member, the hollow tube body having two end parts thereof and being connected, at the two end parts thereof, to a flow path, and made of a flexible material to be deformable, wherein:

the hollow tube body is configured to be deformable by pressurization and depressurization of an outside space formed between (a) an outside tube body arranged outside the hollow tube body and (b) the hollow tube body, the outside space being disposed along the hollow tube body between the two end parts;

the hollow tube body is able to repeatedly perform feeding of liquid from an inside space of the hollow tube body and replenishment of the liquid into the inside space by deformation caused by the pressurization and depressurization of the outside space in a state in which the hollow tube body deforms by the pressurization and depressurization between the two end parts;

an axial cross-section of the hollow tube body has two opposing long side parts and two opposing short side parts during the pressurization and depressurization;

four corner portions formed by the long side parts and the short side parts each have a shape curved to protrude outward during the pressurization and depressurization;

each of the long side parts has a recessed part recessed inward and continuing from the corner portions during the pressurization and depressurization; and a portion other than the corner portions of each of the short side parts is in a flat shape.

2. The hollow tube body according to claim 1, wherein the recessed part of the long side part has a flat part.

3. The tube hollow body according to claim 1, wherein the recessed part of the long side part has a curved shape part protruding inward.

4. The hollow tube body according to claim 1, wherein at least a middle of the recessed part of the long side part is larger in thickness than other portions of the hollow tube body.

5. The tube body according to claim 1, wherein, during the pressurization and depressurization, a straight line length of the recessed part of the long side part is 20 to 60% of a length of the long side part;

a straight line length of the recessed part of the long side part is 100 to 140% of a length of the portion in the flat shape of each of the short side parts; and a length of the long side part is 150 to 190% of a distance between the recessed parts of the long side parts.

6. The hollow tube body according to claim 1, wherein in a state where the liquid exists in the inside space, during pressurization of the outside space, the hollow tube body starts to crush inward at the recessed parts of the long sides while the four corner portions protrude outward and before the flat shape of the short side parts deform.

7. A pumping device which replenishes liquid from a liquid feeding source, the pumping device comprising:

a hollow tube body used for a liquid feeding member, the hollow tube body having two end parts thereof and being connected, at the two end parts thereof, to a flow path, and made of a flexible material to be deformable, and an outside tube body, wherein:

the hollow tube body is configured to be deformable by pressurization and depressurization of an outside space formed between (a) the outside tube body arranged outside the hollow tube body and (b) the hollow tube body, the outside space being disposed along the hollow tube body between the two end parts, the hollow tube body is able to repeatedly perform feeding of liquid from an inside space of the hollow tube body and replenishment of the liquid into the inside space by deformation caused by the pressurization and depressurization of the outside space in a state in which the hollow tube body deforms by the pressurization and depressurization between the two end parts;

an axial cross-section of the hollow tube body has two opposing long side parts and two opposing short side parts during the pressurization and depressurization;

four corner portions formed by the long side parts and the short side parts each have a shape curved to protrude outward during the pressurization and depressurization;

each of the long side parts has a recessed part recessed inward and continuing from the corner portions during the pressurization and depressurization;

a portion other than the corner portions of each of the short side parts is in a flat shape; and the pumping device is configured to feed liquid in the hollow tube body by supplying gas into the outside space, and replenish the liquid from the liquid feeding source into the hollow tube body by venting gas in the outside space to the atmosphere.

8. The pumping device according to claim 7, wherein the recessed part of the long side part has a flat part.

9. The pumping device according to claim 7, wherein the recessed part of the long side part has a curved shape part protruding inward.

10. The pumping device according to claim 7, wherein at least a middle of the recessed part of the long side part is larger in thickness than other portions of the tube body.

11. The pumping device according to claim 7, wherein, during the pressurization and depressurization, a straight line length of the recessed part of the long side part is 20 to 60% of a length of the long side part;

a straight line length of the recessed part of the long side part is 100 to 140% of a length of the portion in the flat shape of each of the short side parts; and a length of the long side part is 150 to 190% of a distance between the recessed parts of the long side parts.

12. The pumping device according to claim 7, wherein in a state where the liquid exists in the inside space, during pressurization of the outside space, the hollow tube body starts to crush inward at the recessed parts of the long sides while the four corner portions protrude outward and before the flat shape of the short side parts deform.

* * * * *